US008267768B2

(12) United States Patent
Taylor

(10) Patent No.: US 8,267,768 B2
(45) Date of Patent: Sep. 18, 2012

(54) GAMING DEVICE WITH PERIMETER BONUSING

(76) Inventor: William Arthur Taylor, Evergreen, CO (US)

( * ) Notice: Subject to any disclaimer, the term of this patent is extended or adjusted under 35 U.S.C. 154(b) by 713 days.

(21) Appl. No.: 11/527,317

(22) Filed: Sep. 27, 2006

(65) Prior Publication Data

US 2007/0087805 A1 Apr. 19, 2007

Related U.S. Application Data

(60) Provisional application No. 60/728,083, filed on Oct. 19, 2005.

(51) Int. Cl.
*A63F 9/24* (2006.01)

(52) U.S. Cl. ..... 463/20

(58) Field of Classification Search ..... 463/20, 463/16

See application file for complete search history.

(56) References Cited

U.S. PATENT DOCUMENTS

| | | | | |
|---|---|---|---|---|
| 6,059,658 | A | 5/2000 | Mangano | |
| 6,328,649 | B1 | 12/2001 | Randall | |
| 6,471,208 | B2 * | 10/2002 | Yoseloff et al. | 273/143 R |
| 6,869,360 | B2 * | 3/2005 | Marks et al. | 463/25 |
| 6,905,407 | B2 | 6/2005 | Nordman | |
| 6,908,381 | B2 | 6/2005 | Ellis | |
| 2003/0054875 | A1 * | 3/2003 | Marks et al. | 463/20 |

* cited by examiner

*Primary Examiner* — Omkar Deodhar

(57) ABSTRACT

A gaming machine is described wherein one or more moving indicators travel around or among slot machine reels granting awards, bonuses or special characteristics to associated symbols on the reels.

16 Claims, 4 Drawing Sheets

GAMING DEVICE WITH PERIMETER BONUSING

This application claims priority to U.S. Provisional Application Ser. No. 60/728,083 filed Oct. 19, 2005, which is incorporated by reference in its entirety herein.

COPYRIGHT NOTICE

This document may contain copyrighted or copyrightable materials. The owner consents to photocopying by anyone only in the form as may be published by the United States Patent Office. Otherwise the owner reserves all rights whatsoever.

FIELD OF THE INVENTION

The invention relates to gambling devices generally and in particular to gaming devices such as slot machines.

BACKGROUND OF THE INVENTION

Slot machines are a form of gaming device well known in the art. Most spin 3 to 5 reels and reward the player according to a published pay schedule that relates to where the reels stop and which symbols are shown across the display portion of the machine. It is common to offer bonus games, alternative wagering methods and other variations to entice players and generate more play.

Slot machine math is critically important. Gaming device operators such as casinos rely on a house advantage to maintain profitability. While players gamble to win in the short run, operators win in the long run.

Some commonly used terms in the art include:

Probability (P). The chance of an event/s usually expressed as a decimal. May also be called odds, often expressed as 1 chance in N trials, or 1 in N.

Cycle (C). The number of possible events on a reel-based slot machine. A game with 3 reels containing 22 stopping positions on each has 22*22*22 possible combinations, or a cycle of 10648.

Hit Frequency (HF). How often winner/s occur usually expressed as a percentage. Also called a win percentage.

Hold Percentage (HP). The portion of bets kept by the operator over the Cycle expressed as a percentage. Also called the house advantage.

Payback Percentage (PB). One less the Hold Percentage (1-HP). The portion of bets returned to players over the Cycle. Also called the return or simply the payback.

Wager (W). The amount risked or bet by the player. Usually a dollar value, but may be in terms of credits or other things of value.

Award (A). The payoff for an event/s. Also called payout. A pay schedule or pay table usually lists all of the possible awards by event.

Random Number Generator (RNG). A computer algorithm that generates random or pseudo random numbers used in gaming devices such as slot and poker machines.

Since players tire of the same old games and play methods, it is desirable to create new gaming devices with greater appeal and new features. New and appealing games stimulate customer play, generate more revenue for game operators and ultimately lead to greater placements of such gaming devices.

Players also like having choices. Several methods have been created to give players more choice and control over their gaming experience. More choices for players often result in new games, gaming devices or play methods that generate more play and ultimately more sales.

Some games today are multi-denominational. These let the player choose the value of their credits without leaving their machine. When feeling lucky they might play in terms of $1.00 per credit. Or, if they're low on funds or during a cold spell they might play the same game at only $0.01 per credit.

Many devices today are multi-games. That is, the player can select which of many game titles they wish to play at the same gaming device.

Since in general more features leads to more enjoyment it is an objective of the present invention to provide gaming patrons new ways to win that are fun, easy to accept and straightforward to implement.

SUMMARY

During the play of a slot machine a moving indicator travels in a path around the reels. When the indicator stops it applies a bonus value to the nearest symbol that is paid if said symbol is involved in a win. Various alternatives exist that include making the indicator an actuator to apply special characteristics to a symbol instead of an award.

DETAILED DESCRIPTION OF THE EMBODIMENTS

In a primary embodiment an invention is described where slot machine reels are surrounded by a border containing values. As the reels spin an indicator or marker moves through adjacent spaces in the border. After the reels stop the moving marker stops on a value, and said value is applied to all payline/s that coincide with the nearest symbol.

Said indicator may be represented by an arrow, a highlight, a halo, a circle, a backlight, a color change or any suitable means.

Figure 1:
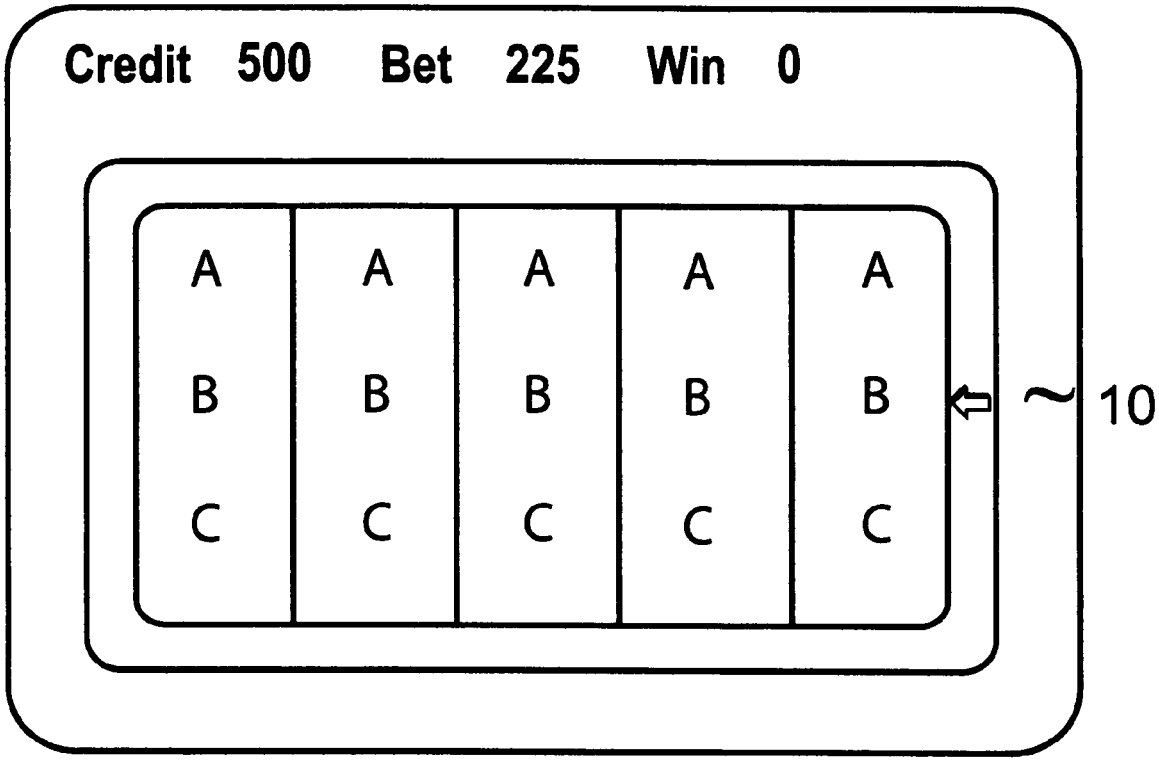
FIG. 1 illustrates a slot machine reel window surrounded by a traveling award marker 10.
Figure 2:
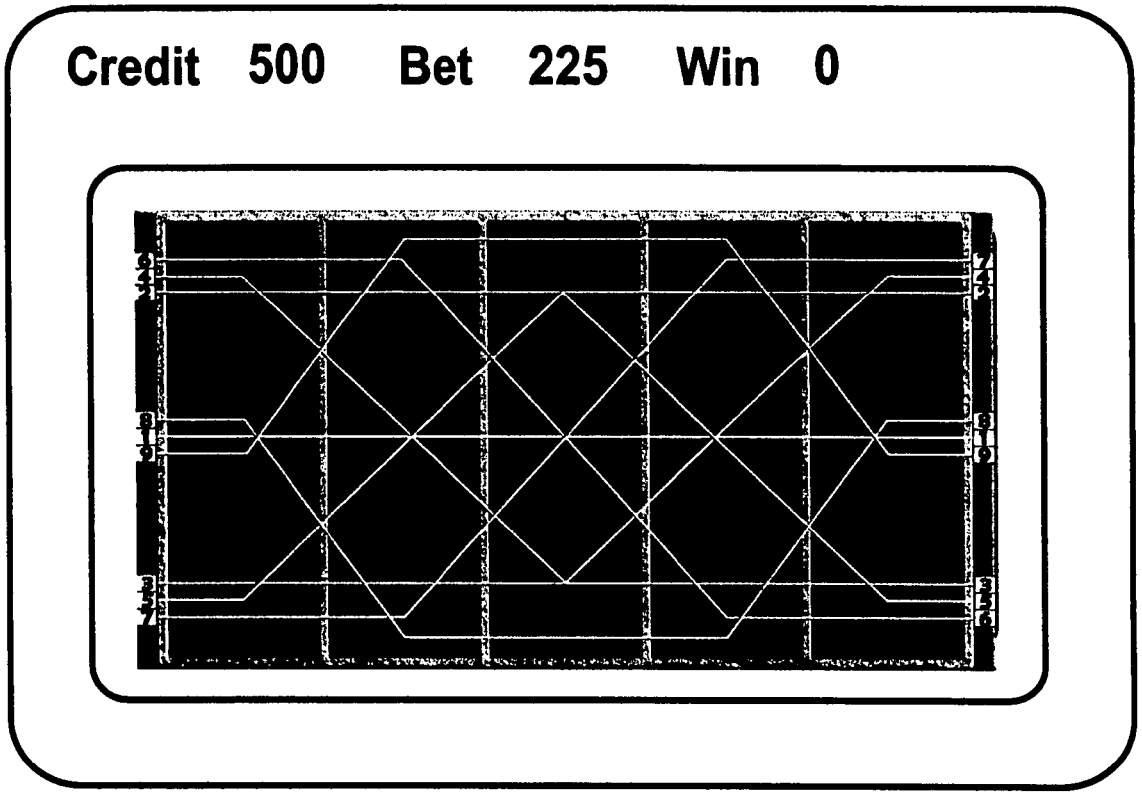
FIG. 2 illustrates one set of possible payline paths in a typical video slot machine reel window.
Figure 3:
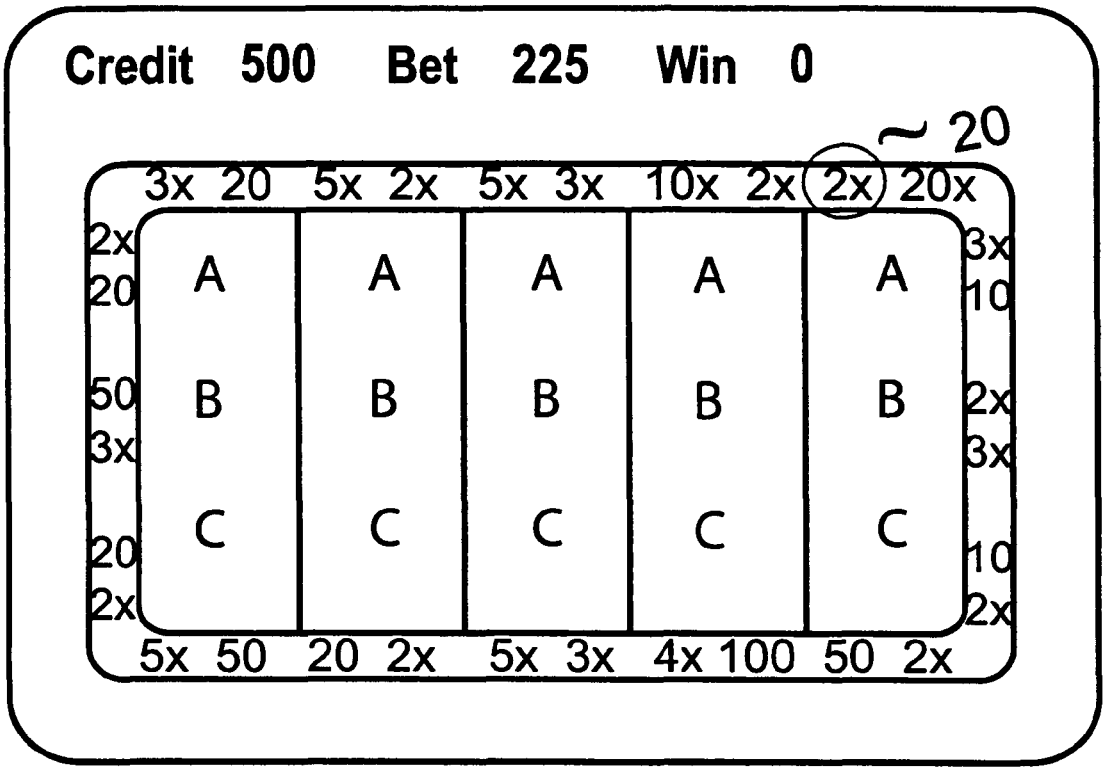
FIG. 3 illustrates a slot machine reel window surrounded by several amounts and multipliers that may be variously highlighted 20 to simulate a traveling award.

In a standard video configuration there are 5 reels displaying 3 symbols each (a "5×3"). A symbol may be comprised of or referred to herein as indicia. Assuming there is one stopping position for each perimeter symbol, there are 12 possibilities as shown in FIG. 1. Normally the moving marker begins at top left and travels clockwise. Stopping is decided by the RNG. Of course there are various other video configurations such as a 4×4, 5×5, 6×3 and more, which may or may not be symmetrical.

The value of the moving marker typically varies from play to play and from position to position. Said value is a multiplier applied to any award paid on or otherwise based on the payline/s using the nearest symbol to the marker even if the marked symbol is not directly involved in the win (if, for example, a 2 of a kind pay is made and the 5th symbol position is highlighted). Alternatively the marker or indicator may act as an actuator to apply special characteristics or attributes to a symbol or to any aspect of indicia instead of an award. Said special characteristics may extend beyond the original confines of the symbol to new positions.

For example, a player gets 5 bars on line 4 whose path resembles an "A" configuration across the 5 reels. The moving marker stops above reel 3. Five bars pay 100 and the moving marker's multiplier value is 3 (which may optionally be displayed as 3×). Thus the player is paid 300 instead of 100.

There are several variations related to this embodiment. The stopping position of the indicator may not be random or pseudo random, but predetermined at the time of betting, it may be weighted so that some positions are more likely than others, it may be a function of other game events such as the bet, game or event history or otherwise. The movement of the indicator may take any motion such as every other space, random or other and not take a direct path through adjacent positions. The distance traveled may be any.

An indicator or indicated symbol may result in a value or award that is fixed, random, stratified random or weighted, a function of the wager or that is determined by one or more other events. The award may not only be a multiplier, but may be an award such as a number of credits and/or something else of value. For example, tools may be awarded for use in a subsequent game segment, or value may lie in triggering one or more bonus events offering the potential for additional wins. Other things of value may include, but are not limited to, any combination of awards and they may even change in function, value or amount at any time.

The indicator may alternatively ascribe initial or subsequent values or characteristics to blank symbols or playing cards.

The indicator may or may not directly or indirectly affect a payline. It may or may not only affect the nearest symbol when that symbol is used in a win. For example, if a 4-in-a-row winner occurs and the indicator stops adjacent to a $5^{th}$ dissimilar symbol on the same payline, there may be no bonus, additional value or award. In another form an indicator might simply pay an award when it stops next to a predetermined collect symbol, or only if one or more collect symbols appear anywhere onscreen having nothing to do with a payline. Or, an award may be paid or a benefit ascribed even if the nearest symbol is not involved directly, or indirectly, in a win.

Similarly a bonused symbol may be at the intersecting point for multiple paylines and so may (or may not) pay multiple times or grant multiple benefits.

In another embodiment the indicator may affect symbol/s other than the nearest symbol/s. For example, the perimeter path taken by the moving marker may take the 165 form of a skating hockey player. At appropriate times a shot is taken and the puck designates one or more symbols to receive an award, characteristic or other benefit. Similarly, other applications may use a path that is not adjacent to the reels or symbols at all, if, for example, the video reel screen is surrounded by a strip of lamps that turn off and on to simulate the position of the moving marker and to highlight values.

In another embodiment activating the indicator requires an additional bet.

In another embodiment the nature of the gaming device screen may take any form such as physical reels or video, which may display any number or type of reels or symbols.

In another embodiment the indicator is only activated by another event or combination of events.

In another embodiment the indicator causes one or more characteristics of the nearest symbol to change. For example, the indicator may cause the nearest symbol to become wild.

In another embodiment a characteristic ascribed to a particular symbol under the manner of the present invention may be perceived as a negative if, for example, it takes away a previously awarded free spin or reduces a symbol's winning value in the paytable.

In another embodiment the player may select one or more actions that the indicator may take upon a symbol from any number of choices provided. Said choices may be predetermined, randomly granted or bought.

In another embodiment the reel indicator moves between or around symbols and reels, either horizontally, vertically, diagonally, around the perimeter, in a non-contiguous fashion or in any combination. The indicator may travel back and forth or around playing cards in games like poker.

In another embodiment the indicator pays or acts differently if it lands on a corner or in other predefined position/s.

In another embodiment there may be any number of indicator stopping positions that correspond to each symbol or in total and it may vary between plays, within a play or at any time.

In another embodiment the indicator continues moving for some time after the reels stop moving. Similarly the indicator may start or stop at any suitable time, or at any position.

The indicator may be stopped and restarted offering the possibility of multiple applications, player choices and/or bets.

In another embodiment there may be multiple indicators moving simultaneously, consecutively, together, independently or in any combination. Each may take the same or different paths or offer the same or different actions. That is, one might pay an award value, while another might be a multiplier, while still another might cause adjacent symbol/s to become wild. Multiple bonused symbols may act in combination if, for example, a 2× bonus and a 3× bonus affect the same or different symbols involved in a pay then 6× may be granted.

In another embodiment, a single indicator may affect more than one symbol. Adjacency may or may not be required.

The value granted by the indicator, the benefit conferred by the indicator or the indicator itself may remain active and span multiple plays of the gaming device, with or without an additional bet option.

In another embodiment the indicator of this invention is applicable to skill games or card games including video poker. In a skill game the indicator may provide some time interval and require a specific player action or game event to occur promptly in order to ascribe the benefit displayed to the current symbol/s. After a time, it may move on.

Figure 4:
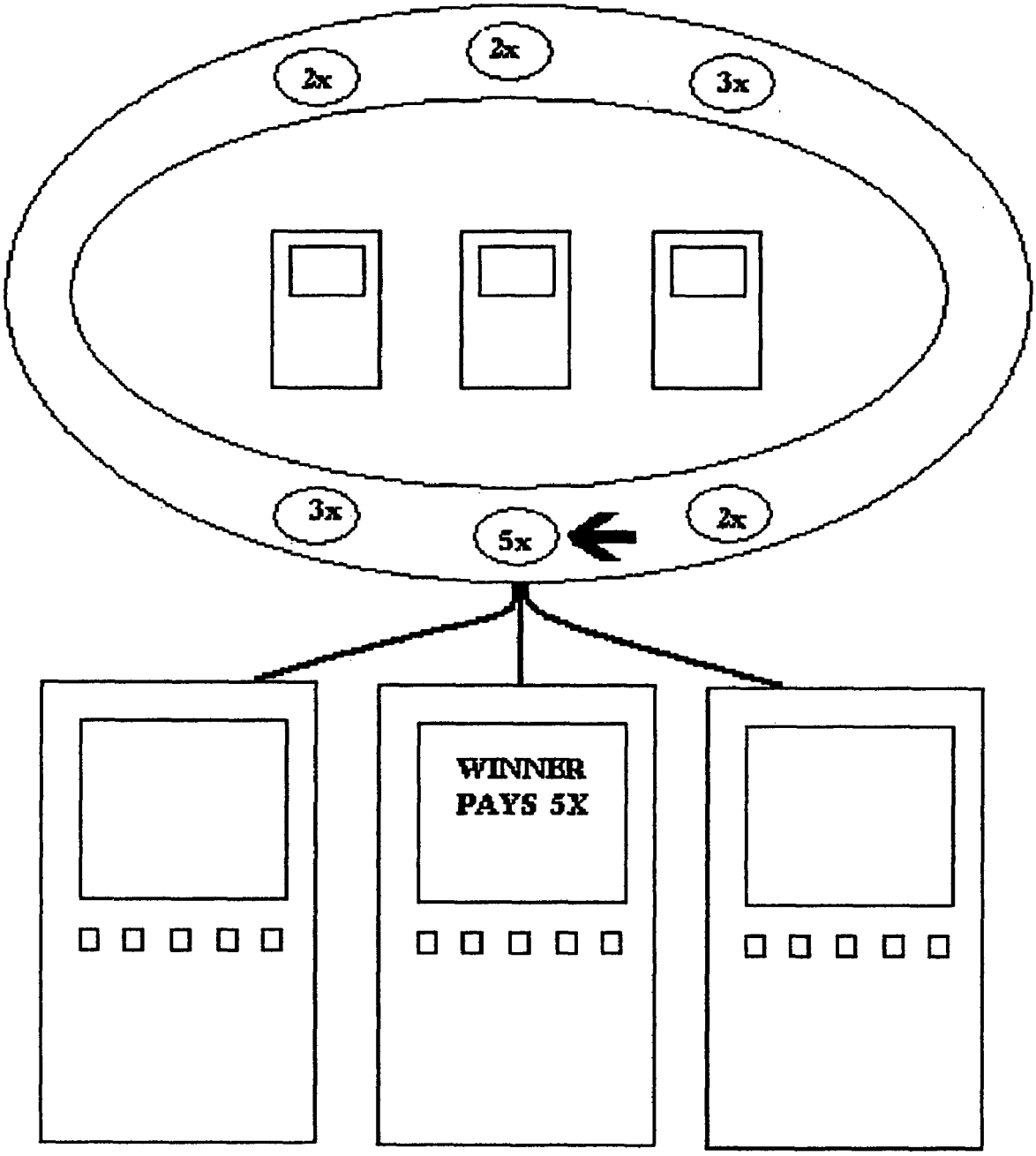
FIG. 4 illustrates one use of a traveling award indicator over a bank of multiple machines.

In another alternative embodiment the games may be networked and all or any aspects shared across multiple machines or ascribed to individual machines. Referring now to FIG. 4, the indicator may apply to a representation of several machines and move from machine to machine. Similarly, it may apply to any subset of represented machines, to only certain lines or symbols of represented machines, or to any portion or combination of represented machine/s and their displays. Benefits may be ascribed to represented machines individually where further actions may be undertaken, or not, by the game program or by the player/s collectively or separately. The indicated benefit may be applied globally to all machines, multiple machines, or applied to all symbols, or to any selection or subset of symbols such as scatters, special symbols, major or minor symbols, blue symbols or paylines. Network versions may optionally employ any or all of the above elements in any combination. Network games may be played and paid individually, or they may be competitive or collaborative among multiple players, gaming positions and/or games. Gaming devices may be standalone machines or function as terminals as in the case of server-based gaming or lottery games.

Thus, this invention adds a new aspect to gaming devices such as slot machines. This adds a favorable anticipation factor beyond just spinning reel outcomes. This invention can also affect the volatility of gaming device returns. In a typical embodiment after the reels spin players are eager to see what their benefit might be from a still moving indicator. The form of this invention is easy to implement, aesthetically pleasing and commercially viable.

OBJECTS AND ADVANTAGES

Several advantages are apparent.

1. First, it's fun. This invention adds to traditional spinning reel play creating anticipation and excitement.

2. Second, players like more choices. In some embodiments the player decides by virtue of the wager whether this invention is activated or not. Thus, it is optional and need not detract from a traditional gaming device if any player desires to play without it.

3. This invention gives games designers new options in game design. It may be used in virtually any slot machine and other gaming devices.

4. This invention may be used to extend playtime and hence perceived value, since the indicator may continue for some time after the reels stop.

5. There is not necessarily a presumption of fairness using such an indicator, so very large bonuses may be displayed but programmed not to hit in an equally weighted fashion.

6. This invention gives player more and new ways to win. Bonuses may be granted in more interesting combinations.

7. In the vein of the best inventions this, in hindsight, is straightforward. It's easy to understand, simple to play and easy to implement.

This disclosure is provided to allow practice of the invention by those skilled in the art without undue experimentation, including the best mode presently contemplated and the presently preferred embodiment. There are numerous variations falling within the scope of the invention. Any subset or combination of the above methods, player selections, means or forms of wagering or paying, finding winners and losers and/or displaying or otherwise presenting selections, indicators or outcomes may be used. This invention may be employed with any combination of games or options including, but not limited to, bonuses, random or mystery awards, multipliers, progressives, other games, player skill components, other features, side bets, wagering or play methods. This invention may be employed in whole or in part, or itself as a bonus, add-on or otherwise in conjunction with new or traditional gaming devices or methods. Thus, these and all embodiments described should be viewed as illustrative, rather than limiting. Nothing in this disclosure should be taken to limit the scope of the invention, which is susceptible to numerous alterations, equivalents and substitutions without departing from the scope and spirit of the invention. The scope of the invention is to be understood from the appended claims.

I claim:

1. A method of presenting a wagering game to a player at a gaming machine comprising the steps of:

accepting a wager from said player;

displaying a plurality of primary game symbols in a first plurality of symbol positions, one or more combinations of least one of said primary game symbols defining pre-determined winning outcomes and one or more combinations of at least one of said primary game symbols defining non-winning outcomes;

displaying at least one enhancing symbol in one of a second plurality of symbol positions, one or more of said second plurality of symbol positions being adjacent to one or more of said first plurality of symbol positions;

selecting one or more of said enhancing symbols;

determining if one or more of said primary game symbols comprises at least one winning outcome; and if not, ending said game; and if so, (i) determining a base award for said at least one winning outcome and (ii) determining if one or more of said selected enhancing symbols are located in one of said second plurality of symbol positions which are located in an adjacent position to one of said plurality of first symbol positions containing a primary symbol of one of said winning outcomes and (iii) determining if one or more of said selected enhancing symbols is not located in one of said second plurality of symbol positions adjacent to one of said plurality of first symbol positions containing a primary symbol of one of said winning outcomes; and if the one or more of said selected enhancing symbols is not located in one of said second plurality of symbol positions adjacent to one of said plurality of first symbol positions containing a primary symbol of one of said winning outcomes, then awarding said base award; and if the one or more of said selected enhancing symbols is located in one of said second plurality of symbol positions which are located in an adjacent position to one of said plurality of first symbol positions containing a primary symbol of one of said winning outcomes, enhancing said base award in accordance with rules applying to said enhanced symbol.

2. The method in accordance with claim 1 wherein at least one enhancing symbol comprises a multiplier.

3. The method in accordance with claim 1 wherein at least one enhancing symbol comprises a bonus award value.

4. The method in accordance with claim 1 wherein said first plurality of symbol positions comprise positions of an n×m matrix and said second plurality of symbol positions comprise a border around said matrix.

5. The method in accordance with claim 1 wherein said first plurality of symbol positions comprise positions of a plurality of reels.

6. The method in accordance with claim 1 wherein at least one winning outcome comprises a scatter combination of primary game symbols throughout said first plurality of symbol positions.

7. The method in accordance with claim 1 wherein at least one winning outcome comprises a combination of primary game symbols along one or more paylines through said first plurality of symbol positions.

8. The method in accordance with claim 1 comprising the step of randomly selecting said at least one enhancing symbol, but not all of said enhancing symbols, from a plurality of displayed enhancing symbols.

9. A method of presenting a wagering game to a player at a gaming machine comprising the steps of:

accepting a wager from said player;

displaying a plurality of game symbols in a plurality of main positions;

displaying a plurality of enhancing symbols in a plurality of secondary positions, one or more of said secondary positions being adjacent to one or more of said main positions;

selecting one or more of said enhancing symbols;

evaluating said plurality of game symbols for winning game outcomes; and enhancing an award for at least each winning game outcome wherein one or more of said selected enhancing symbols are located in one of said plurality of secondary positions which is an adjacent position to one of said plurality of main positions containing a game symbol of said winning game outcome and not enhancing an award for at least each winning game outcome wherein one or more of said selected enhancing symbols are not located in one of said plurality of secondary positions which is an adjacent position to one of said plurality of main positions containing a game symbol of said winning game outcomes.

10. The method in accordance with claim 9 wherein at least one enhancing symbol comprises a multiplier.

11. The method in accordance with claim 9 wherein at least one enhancing symbol comprises a bonus award value.

12. The method in accordance with claim 9 wherein said plurality of main positions comprise positions of an n×m matrix and said plurality of secondary positions comprise a border around said matrix.

13. The method in accordance with claim 9 wherein said plurality of main positions comprise positions of a plurality of reels.

14. The method in accordance with claim 9 wherein at least one winning game outcome comprises a scatter combination of game symbols throughout said plurality of main positions.

15. The method in accordance with claim 9 wherein at least one winning game outcome comprises a combination of game symbols along one or more paylines through said plurality of main positions.

16. The method in accordance with claim 9 comprising the step of randomly selecting said at least one enhancing symbol, but not all of said enhancing symbols, from a plurality of displayed enhancing symbols.

* * * * *